US008152496B2

(12) United States Patent
White

(10) Patent No.: US 8,152,496 B2
(45) Date of Patent: Apr. 10, 2012

(54) CONTINUING COMPRESSOR OPERATION THROUGH REDUNDANT ALGORITHMS

(75) Inventor: Robert C. White, San Diego, CA (US)

(73) Assignee: Solar Turbines Inc., San Diego, CA (US)

( * ) Notice: Subject to any disclaimer, the term of this patent is extended or adjusted under 35 U.S.C. 154(b) by 855 days.

(21) Appl. No.: 12/149,474

(22) Filed: May 2, 2008

(65) Prior Publication Data

US 2009/0274565 A1 Nov. 5, 2009

(51) Int. Cl.
*F04B 23/00* (2006.01)
*F04B 41/00* (2006.01)
*F04B 49/035* (2006.01)

(52) U.S. Cl. ..... 417/440; 417/53; 417/282; 417/300; 417/307

(58) Field of Classification Search ..... 417/18, 417/20, 22, 26, 42, 43, 44.2, 53, 279, 282, 417/293, 300, 307, 440
See application file for complete search history.

(56) References Cited

U.S. PATENT DOCUMENTS

| | | | | |
|---|---|---|---|---|
| 3,555,844 | A | | 1/1971 | Fleckenstein et al. |
| 4,151,725 | A | | 5/1979 | Kountz et al. |
| 4,156,578 | A | | 5/1979 | Agar et al. |
| 4,228,650 | A | * | 10/1980 | Camp ..... 60/39.091 |
| 4,464,720 | A | | 8/1984 | Agarwal |
| 4,861,233 | A | | 8/1989 | Dziubakowski et al. |
| 5,618,160 | A | | 4/1997 | Harada et al. |
| 5,851,103 | A | | 12/1998 | Harada et al. |

FOREIGN PATENT DOCUMENTS

| | | |
|---|---|---|
| EP | 0886069 A2 | 12/1998 |
| EP | 0686774 B1 | 8/1999 |

OTHER PUBLICATIONS

Kurz, Rainer et al., "Pulsations in Centrifugal Compressor Installations," Marine Microturbines and Small Turbomachinery Oil and Gas Applications Structures and Dynamics: General, vol. 5, part A, ASME, New York, New York, 2006, 10 pgs.
White, Robert C. et al., "Surge Avoidance for Compressor Systems," 35$^{th}$ Turbomachinery Symposium, Curran Associates, Inc., Red Hook, New York, 2006, 13 pgs.

* cited by examiner

*Primary Examiner* — Devon C Kramer
*Assistant Examiner* — Bryan Lettman
(74) *Attorney, Agent, or Firm* — Finnegan, Henderson, Farabow, Garrett & Dunner LLP

(57) ABSTRACT

A method of operating a compressor of a compressor system uses three models. Each model of the three models describes a surge line of the compressor as a function of any two of three operating parameters of the compressor. The three operating parameters include head (H), flow (Q), and speed (N). The method includes measuring operating characteristics of the compressor system using sensors, and determining a current value of the three operating parameters based on at least some of the measured operating characteristics. The method also includes locating operating points of the compressor on each of the three models based on the current value of the operating parameters, and identifying a sensor fault that affects the determination of at least one of the operating parameters. The method further includes avoiding surge of the compressor using one model of the three models. The one model being a model that is a function of two operating parameters unaffected by the sensor fault.

20 Claims, 3 Drawing Sheets

CONTINUING COMPRESSOR OPERATION THROUGH REDUNDANT ALGORITHMS

TECHNICAL FIELD

The present disclosure relates generally to a method of compressor operation, and more particularly, to a method of compressor operation through redundant algorithms.

BACKGROUND

A dynamic compressor is one of the most commonly used means for gas compression in industry. Common dynamic compressors include centrifugal and axial flow compressors. During operation, a dynamic compressor can become unstable due to changes in various operating conditions (such as, gas composition, flow rate, speed, pressure, etc.), causing rapid pulsations in flow. This phenomenon is called surge. Surge conditions occur in a dynamic compressor when the inlet flow is reduced to the extent that the compressor, at a given speed, can no longer operate at the existing head. At this point, a momentary reversal in flow occurs resulting in a drop in head. Normal compression resumes and the phenomenon repeats. This surge phenomenon is highly undesirable since the resulting noise, vibration, and over heating can lead to mechanical damage of the compressor, associated instrumentation, and piping. Various surge avoidance schemes are used with dynamic compressors to prevent surge.

A typical surge avoidance scheme avoids surge by activating a bypass valve to redirect flow around the compressor when the compressor approaches a surge condition. The compressor approaches a surge condition when a compressor operating point approaches a preset compressor surge limit. When the compressor operating point approaches the surge limit, the bypass valve opens to redirect a portion of gas from the discharge side of the compressor to the suction side, thereby reducing the head across the compressor. The reduced head increases flow through the compressor, thereby preventing surge.

The compressor surge limit is typically obtained from characteristic set point curves ("compressor maps") provided by the compressor manufacturer. These compressor maps define a zone for stable operation of the compressor. Common compressor maps define a surge line of the compressor as a function of three variables—head, flow, and the speed. These variables are typically determined based on sensor readings of various operating conditions of the compressor. The compressor operating point at any particular time may be plotted on the compressor map using measured/determined values of head, flow, and speed, at that time. When the operating point approaches the surge line, a surge condition is detected, and the bypass valve is opened to redirect flow from the discharge side to the suction side or simply pass it off through a blow-off line to prevent surge. A defect in a sensor used to determine head, flow, or speed, may cause a fault in the surge avoidance system. Typically, a compressor may be shut down in response to a faulty surge avoidance system to avoid surge of the compressor. Unplanned shut down of the compressor may affect down stream operations and productivity.

Various attempts have been made to develop suitable surge avoidance techniques to minimize compressed gas bypass while maintaining the compressor in a surge free state. U.S. Pat. No. 4,861,233 (the '233 patent) issued to Dziubakowski et al. on Aug. 29, 1989 describes a dynamic compressor surge control system which provides anti-surge protection in proportion to the magnitude of the anticipated surge condition. The control system of the '233 patent anticipates a surge condition in advance of the surge line in the compressor map by establishing a surge control line, offset from the surge line, using a control signal. When the operating point of the compressor in the '233 patent approaches the surge control line, anti-surge measures are initiated. The control signal of the '233 patent, which establishes the surge control line, is based on a control variable other that the one used to establish the surge line. The offset of the surge control line from the surge line, in the '233 patent, varies depending upon the rate of change of the control variable and provides an indication of the magnitude of the anticipated surge condition.

While the control system of the '233 patent may initiate surge avoidance measures depending upon the magnitude of the anticipated surge condition, the control system still relies on trouble free performance of multiple sensors to measure different parameters that establish the operating point. A defective sensor may indicate an erroneous value of one of measured parameters, causing faulty operation of the surge control mechanism. In response to a faulty operation of the surge control mechanism, the compressor may need to be shut down for sensor repair/replacement, or operated in an excessively conservative manner to ensure that that the compressor does not surge. Unplanned shut down, or a significant reduction in compressor performance, may adversely effect upstream or downstream equipment/operations and productivity.

SUMMARY OF THE INVENTION

In one aspect, a method of operating a compressor of a compressor system is disclosed. The method uses three models. Each model of the three models describes a surge line of the compressor as a function of any two of three operating parameters of the compressor. The three operating parameters include head H, flow Q, and speed N. The method includes measuring operating variables of the compressor system using sensors, and determining a current value of the three operating parameters based on at least some of the measured operating variables. The method also includes locating operating points of the compressor on each of the three models based on the current value of the operating parameters, and identifying a sensor fault that affects the determination of at least one of the operating parameters. The method further includes avoiding surge of the compressor using one model of the three models. The one model being a model that is a function of two operating parameters unaffected by the sensor fault.

In another aspect, a system for operating a compressor is disclosed. The system includes multiple sensors configured to measure operating variables of the compressor, and a control system configured to determine three operating parameters of the compressor based on the measured variables. The three operating parameters include head H, flow Q, and speed N. The control system is also configured to use three models to describe surge of the compressor. Each model of the three models describe surge as a function of any two of the three operating parameters. The control system is also configured to locate operating points of the compressor on each of the three models. The operating points are located based on the determined operating parameters. The control system is also configured to select one model of the three models in response to a fault of one or more of the multiple sensors. The control system is further configured to identify an impending surge condition of the compressor based on the one model. The system also includes a bypass valve configured to bypass gas from a discharge side of the compressor to a suction side in response to the identified impending surge condition.

In yet another aspect, a method of compressor operation is disclosed. The method includes determining values of three operating parameters of the compressor based on measured variables of the compressor. The three operating parameters are head H, flow Q, and speed N. The method also includes describing a surge line of the compressor using three models, the three models include a first model that describes the surge line as a function of N and Q, a second model that describes the surge line as a function of H and N, and a third model that describes the surge line as a function of H and Q. The method further includes selecting one model of the three models when a fault affects the value of one of the determined operating parameters, and performing bypass when the one model indicates an impending surge condition.

DETAILED DESCRIPTION

Figure 1:
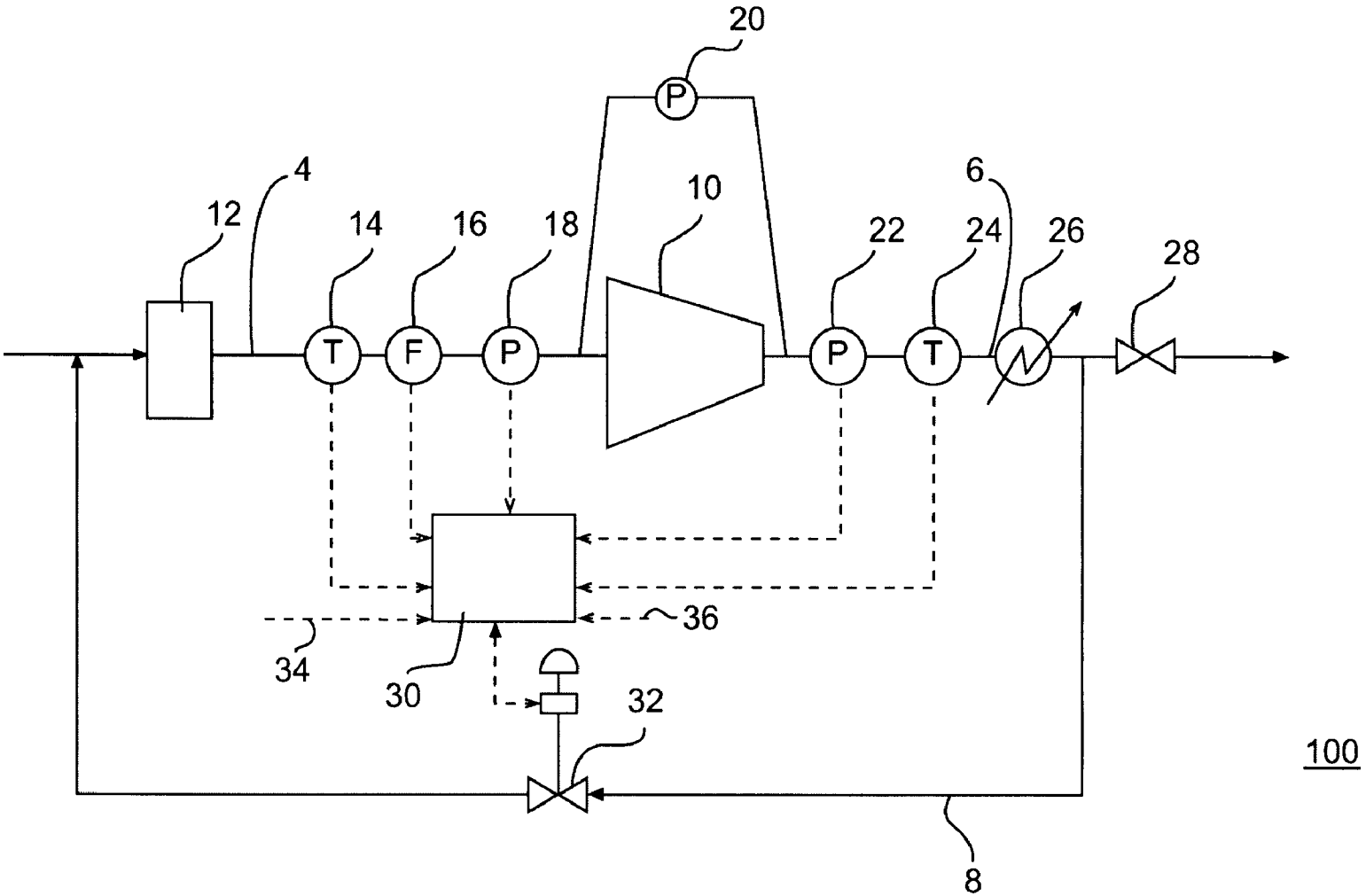
FIG. 1 is a schematic illustration of a dynamic compressor with a surge avoidance system.

FIG. 1 is a schematic illustration of a dynamic compressor system 100. Compressor system 100 may be part of a larger system operating in any environment. Compressor system 100 may include a dynamic compressor 10. Compressor 10 may include any type of dynamic compressor (such as, axial flow, radial flow, etc.), known in the art, capable of compressing a gas. Any type of gas (such as, air, natural gas, etc.) may be compressed using compressor 10. The gas may be directed to compressor 10 through inlet passage 4 from any source. In some embodiments, a gas scrubber 12 may be provided in inlet passage 4 to clean the inlet gas. Compressor 10 may include rotating and stationary parts (such as, aerofoils) that may cooperate to compress the gas to a desired pressure. Compressor 10 may be operatively coupled to a power source (such as, motor, turbine, etc.) to rotate the rotating components of the compressor. The gas compressed in compressor 10 may be directed from compressor 10 through outlet passage 6. This compressed gas may then be used to perform another operation.

Compressor system 100 may include a plurality of measurement devices ("sensors") to measure operating characteristics (suction pressure, discharge pressure, inlet temperature, outlet pressure, etc.) of compressor 10. Some of these sensors may be coupled to the inlet or the outlet passage 4, 6, while some other sensors may be coupled to other related systems. For instance, sensors coupled to inlet and outlet passage 4, 6 may measure characteristics of the gas flowing into and out of compressor 10, and sensors coupled to the power source (for example, turbine) driving the compressor may measure the rotational speed of compressor 10. These sensors may include pressure sensors, temperature sensors, flow sensors, etc. Any sensor known in the art may be used with compressor system 100. In the embodiment depicted in FIG. 1, these sensors include a first temperature sensor 14, a flow meter 16, and a first pressure sensor 18 coupled to inlet passage 4, a second pressure sensor 22, and a second temperature sensor 24 coupled to outlet passage 6. It should be emphasized that the sensors depicted in FIG. 1 are exemplary only, and that different embodiments of compressor system 100 may include sensors different from those illustrated in FIG. 1. In general, compressor system 100 may include sensors configured to measure the characteristics needed to determine the operating parameters, head H, flow Q, and speed N, of compressor system 100.

First and second temperature sensors 14 and 24 may measure the temperature of gas entering and leaving compressor 10. First pressure sensor 18 and second pressure sensor 22 may measure the pressure of gas entering (suction pressure $P_s$) and leaving (discharge pressure $P_d$) compressor 10. In some embodiments, in place of the first and second pressure sensors 18 and 22, a differential pressure sensor 20 may be coupled across compressor 10 to measure the pressure differential across compressor 10. It is also contemplated (as illustrated in FIG. 1), that differential pressure sensor 20 may be provided in addition to first and second pressure sensors 18 and 22. Flow meter 16 may include any device configured to measure the flow of gas flowing through inlet passage 4. In some embodiments, flow meter 16 may include a differential pressure sensor that measures the pressure differential across a flow restriction mechanism (such as, an orifice, pitot, etc.), and determines flow Q based on the measured pressure differential, properties of the gas, and geometry of the flow restriction device (area of the orifice, etc.), using methods known in the art. These pressure, temperature and flow sensor may transmit the measured data to a control system 30.

A bypass passage 8 may also be coupled to outlet passage 6 to redirect compressed gas from outlet passage 6 to inlet passage 4. Although FIG. 1 depicts bypass passage 8 coupled to outlet passage 6 downstream of intercooler 26 (and upstream of valve 28) and coupled to inlet passage 4 upstream of scrubber 12, it is contemplated that in some embodiments, bypass passage 8 may be couple inlet and outlet passages 4, 6 at other locations. In some embodiments, bypass passage 8 may also include one or more sensors configured to measure characteristics of the gas passing through bypass passage 8. These sensors may also transmit the measured characteristics to the control system 30.

Control system 30 may be configured to receive the measured characteristics from the various sensors coupled to compressor system 100. For instance, control system 30 may receive input from the sensors coupled to inlet and outlet passages 4 and 6, and shaft speed signal 34 from a turbine driving compressor 10. The shaft speed signal 34 may be indicative of the rotational speed of compressor 10. Control system 30 may also receive input from fault detection circuitry 36 configured to detect a fault in a sensor.

Control system 30 may include components that may perform computation and control functions. These components may include, among others, memory, storage device to store data, devices to receive the transmitted data, and processors to perform analyses of the data. Also associated with electronic control system 30 may be various other known circuits (such as, for example, power supply circuitry, signal conditioning circuitry, solenoid driver circuitry, etc.) and devices (such as, a monitor, keyboard, mouse, etc.) to support the functioning of control system 30. Control system 30 may analyze the received data, user input data and the stored data to perform various control functions.

The analyses performed by control system 30 may include determination of various operating parameters of compressor 10. Control system 30 may determine compressor operating parameters, such as head H, flow Q, and speed N, based (at least partly) on the measured characteristics using well known thermodynamic relations (which can be found in thermodynamics and fluid dynamics textbooks known in the art). Flow Q may be a measure of the flow of gas into compressor 10. In some embodiments, flow Q may represent the mass flow rate or volumetric flow rate into compressor 10, while in other embodiments, Q may represent a non-dimensional flow into compressor 10. In some embodiments, the pressure head across flow meter 16 may be used as a measure of gas flow. In this disclosure, flow Q is broadly used as a representation of flow of gas into compressor 10. Head H may be a measure of the energy expended by compressor 10 on the gas. In some embodiments, discharge pressure ($P_d$), or a pressure ratio (such as $P_d/P_s$) may be used as a measure of head H, while in other embodiments, a more complex relation may be used. In this disclosure, head H is broadly used to represent any representation of compressor head known in the art. Speed N may be a measure of speed of compressor 10. In some embodiments, the shaft speed or rotational speed may be used, while in other embodiments, some other form of speed may be used.

In some embodiments, control system 30 may determine head H based on data from first and second pressure sensor 18, 22, and data from first and second temperature sensor 14, 24. Control system may also determine head based on data from one or both of the temperature sensors and differential pressure sensor 20. Flow Q through compressor 10 may be determined by control system 30 based on data from first pressure sensor 18, first temperature sensor 14, and flow meter 16. Speed N may be determined from shaft speed signal 34. It is also contemplated that head H, flow Q, and speed N may be determined using data from other sensors.

Control system 30 may perform various control functions of compressor system 100 based, at least partly, on the results of the analyses. For instance, control system 30 may operate a bypass valve 32 to control the operation of compressor 10 to avoid surge of compressor 10. Bypass valve 32 may be coupled to bypass passage 8 and configured to open and close bypass passage 8 in response to a signal from control system 30. Opening bypass valve 32 may bypass gas from the discharge side to the suction side Based on the determined operating parameters, control system 30 may determine the susceptibility of compressor system 100 to surge. This determination may include locating an operating point of compressor 10 on one or more compressor maps. A compressor map is a performance map of compressor 10 that may be obtained experimentally or obtained using computer programs. These compressor maps may be determined on site or may be obtained from a manufacturer of compressor 10.

Figure 2A:
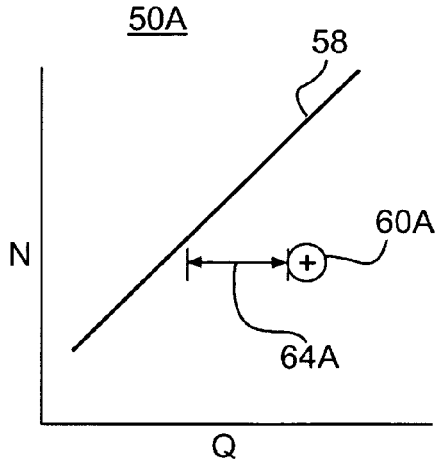
FIGS. 2A-2C are illustrations of three different compressor maps used in compressor system of FIG. 1.
Figure 2B:
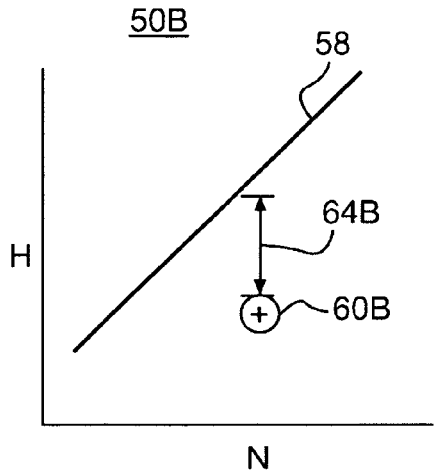
Figure 2C:
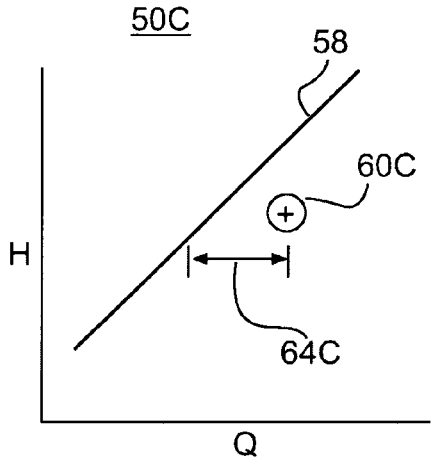

FIGS. 2A-2C illustrates three compressor maps (a first compressor map 50A, a second compressor map 50B, and a third compressor map 50C) on which operating point (60A, 60B, and 60C) may be located. Each compressor map may describe the operation of compressor 10 based on two of the three operating parameters (H, Q, and N). FIG. 2A illustrates first compressor map 50A based on speed N and flow Q. FIG. 2B illustrates second compressor map 50B based on head H and speed N. FIG. 3C illustrates third compressor map 50C based on head H and flow Q. Control system 30 may locate operating point 60A on compressor map 50A using the measured values of N and Q, operating point 60B on compressor map 50B using the measured values of H and N, and operating point 60C on compressor map 50C using the measured values of H and Q. In each of these compressor maps, a surge line 58 may define the stability limit of compressor 10. The area of compressor map (50A, 50B, and 50C) towards the right of surge line 58 may represent the stable operation regime of compressor 10, and the area to the left of surge line 58 may represent a surge zone of compressor 10. Although, surge line 58 is depicted in FIGS. 2A-2C as a straight line, the configuration of surge line 58 may generally depend upon the type of compressor 10. Typically, single stage compressors may have a substantially linear surge line 58 (as depicted in FIGS. 2A-2C), while multi-stage compressors may have bilinear or curved surge lines.

The distance of operating point (60A, 60B, 60C) from surge line 58 may be indicative of an approach of a surge condition of compressor 10. Decreasing distance of operating point (60A, 60B, 60C) from surge line 58 may indicate the approach of a surge condition. The distance of operating point 60A in compressor map 50A may be defined as the surge margin 64A. Surge margin 64A may be the separation in flow from operating point 60A to surge line 58 at constant speed. The distance of operating point 60B in compressor map 50B may be defined as the head rise to surge 64B. Head rise to surge 64B may be the separation in head from operating point 60B to surge line 58 at constant speed. The distance of operating point 60C in compressor map 50C may be defined as turndown 64C. Turndown 64C may be the separation of flow Q from operating point 60C to surge line 58 at constant head. When one or more of turndown 64C, head rise to surge 64B, and surge margin 64A decreases below a predetermined value control system 30 may operate bypass valve 32 to avoid surge. Once surge has been avoided, control system 30 may close bypass valve 32 to bring compressor 10 back to a stable operating zone.

When all sensors are functioning correctly, operating points (60A, 60B, and 60C) in all three compressor maps (first compressor maps 50A, second compressor map 50B, and third compressor map 50C) may correctly identify a surge condition. In such a scenario, any one of the three compressor maps 50A, 50B and 50C may be used by control system 30 to avoid surge of compressor 10. The dependence of operating point 60C (of third compressor map 50C) on gas composition may be minimized by representing H as a function of head across compressor 10, and Q as the head across flow meter 16. That is, H may be represented as a function of $(P_d/P_s)^{Compressor}$, and Q may be represented as a function of $(P_d/P_s)^{flow\ meter}$, where $(P_d/P_s)^{Compressor}$ and $(P_d/P_s)^{flow\ meter}$ are the head across compressor 10 and flow meter 16, respectively. While operating points 60A and 60B of the first and second compressor maps 50A and 50B may drift when the gas composition changes, operating point 60C may be relatively unaffected by this change. Therefore, in some embodiments, control system 30 may rely on turndown 64C (determined from third compressor map 50C) to avoid surge when all sensors are functioning correctly. In some embodiments, turndown 64C determined from third compressor map may be used to update the locations of operating points 60A and 60B when all sensors are working correctly. Updating of operating points 60A and 60B may correct the drifting of these operating points due to changes in gas composition. Updating of operating points 60A and 60B may be carried out by calculating a corrected value of speed N based on the location of operating point 60C on third compressor map 50C.

Since each operating point (60A, 60B, and 60C of first compressor map 50A, second compressor map 50B, and third compressor map 50C, respectively) are defined by only two of the three operating parameters, a sensor malfunction that causes an error in one of the operating parameters, will only introduce an error in only two of the three compressor maps. For instance, an error in a sensor that measures a characteristic used to determine H may cause an error in operating points 60B and 60C (of second and third compressor maps 50B and 50C). Operating point 60A in first compressor map 50A, meanwhile, may be unaffected by this error in the determined value of H. Control system 30 may now use first compressor map 50A to avoid surge when surge margin 64A decreases below a predetermined value.

In some embodiments, a fault detection circuitry 36 may indicate a fault in a sensor. Control system 30 may select a compressor map that may be unaffected by the faulty sensor until the faulty sensor is rectified. In some embodiments, the location of operating point on the compressor maps may indicate a sensor failure. In these embodiments, the location of an operating point outside an expected range may indicate an erroneous value. For instance, a fault in a sensor used to determine H may cause operating points 60B and 60C to go outside an expected range of H (that is, outside an expected Y-axis range in second and third compressor maps 50B and 50C). Operating points 60B and 60C, outside the expected range, may indicate a fault in a sensor used to determine H. This information may be used to identify and rectify a faulty sensor.

In some cases, control system 30 may attempt to compute some of the faulty operating parameters using data from other sensors. For instance, in an embodiment where H is determined using data from first pressure sensor 18, second pressure sensor 22, first temperature sensor 14, and second temperature sensor 24; Q is determined using data from first pressure sensor 18, first temperature sensor 14, and flow meter 16; and speed N is determined from shaft speed signal 34, a fault in the first pressure sensor 18 may cause the determined values of both H and Q to be erroneous. In such a scenario, control system 30 may attempt to calculate H and Q based on thermodynamic relations using data from the remaining sensors. For instance, in the case of a faulty first pressure sensor 18, control system 30 may recalculate H based on data from differential pressure sensor 20. However, accurate computation of Q may not be possible, and control system 30 may use second compressor map 50B to operate bypass valve 32 when head rise to surge 64B decreases below a threshold value. Control system 30 may, thus, select a compressor map that is unaffected by the faulty sensor, and use the selected compressor map to avoid surge in the event of a sensor fault. Operation of compressor system 100 may continue in such a manner until the defective sensor is repaired.

Industrial Applicability

The disclosed method of compressor operation may be applicable to any dynamic compressor where continued operation of the compressor is desired in the event of a sensor failure. In the event of a sensor failure, the disclosed method of compressor operation may avoid surge of the compressor by selecting a model that is unaffected by the defective sensor. The disclosed method of compressor operation uses three compressor maps (or models) that determine the operating point of the compressor as a function of two of three operating parameters of the compressor. When the model indicates that the compressor is approaching a surge condition, a control system operates a bypass valve to redirect compressed gas from the discharge side to the suction side of the compressor, to bring the compressor back to a stable operating zone. An exemplary operation of the method of the current disclosure will now be explained.

Compressor system 100, that includes a dynamic compressor 10 operatively coupled to a gas turbine engine, may compress natural gas delivered to compressor 10 through inlet passage 4, and discharge the compressed gas through outlet passage 6. A bypass passage 8, having bypass valve 32, may also be coupled between the inlet and outlet passage (4 and 6). Multiple sensors coupled to compressor system 100 may measure data associated with the functioning of compressor system 100. These sensors may transmit the measured data to control system 30. Control system 30 may determine three operating parameters H, Q, and N of compressor 10 based on the measured data. Control system 30 may also define a surge line 58 of compressor 10 on a first, second, and third compressor map 50A, 50B, and 50C. Control system 30 may then locate operating points 60A, 60B, and 60C, that define the current state of compressor 10, on the first, second, and third compressor map 50A, 50B, and 50C, respectively. Based on the distance of the operating point (60A, 60B, 60C) from surge line 58, control system 30 may determine surge margin 64A, head rise to surge 64B, and turndown 64C from the first, second, and third compressor map 50A, 50B, and 50C, respectively. Threshold values of surge margin 64A, head rise to surge 64B, and turndown 64C may also be included in control system 30. When all sensors are functioning normally, control system 30 may avoid surge of compressor 10 by opening bypass valve 32 when turndown 64C decreases below a threshold turndown value. When a fault indicator signal indicates a fault in a sensor, control system 30 may continue to avoid surge of compressor using the compressor map that is unaffected by the sensor failure. Control system 30 may continue using the unaffected compressor map to avoid surge until the sensor failure is rectified.

Figure 3:
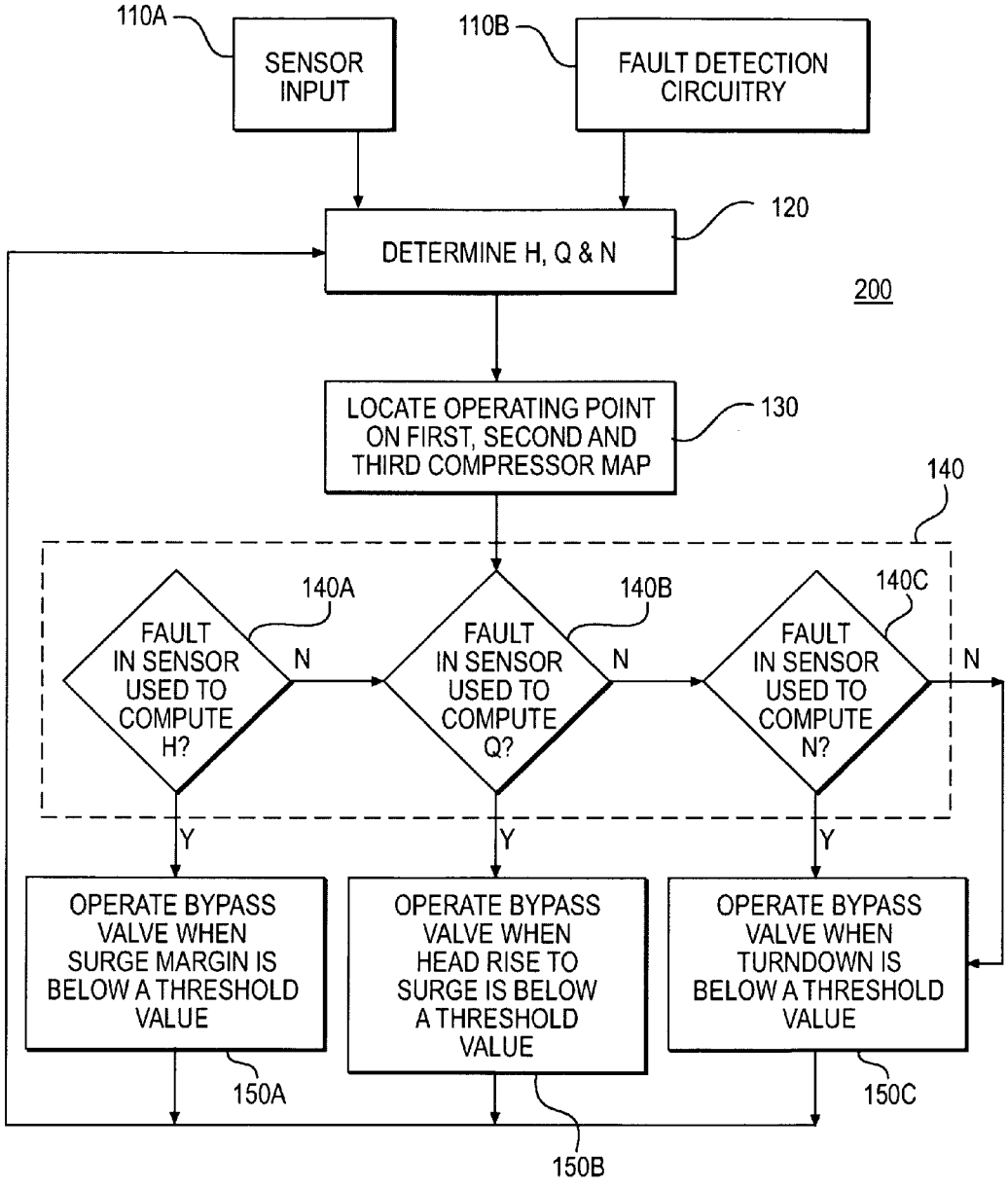
FIG. 3 is a flow chart illustrating an exemplary surge avoidance technique using the system of FIG. 1.

FIG. 3 illustrates a flow chart 200 that illustrate the avoidance of surge of compressor 10 by control system 30. Control system 30 may continuously receive feedback from sensors and fault detection circuitry that identifies a failure in a sensor (steps 110A and 110B). Based at least partly on the sensor inputs, control system may determine the operating parameters, H, Q, and N, of compressor 10 (step 120). Using the determined operating parameters, control system 30 may also locate the current operating point (60A, 60B, 60C) of compressor 10, and determine surge margin 64A, head rise to surge 64B, and turndown 64C from the first, second, and third compressor maps respectively (step 130). Control system 30 may continue monitoring the fault detection circuitry to detect a failure of a sensor (step 140). If a failure of a sensor that is used to determine operating parameter H is detected (step 140A), control system 30 may rely on the first compressor map 50A to avoid surge of compressor 10. That is, control system 30 may avoid surge by operating bypass valve 32 when surge margin 64A decreases below a threshold surge margin value (step 150A). If a fault in a sensor that is used to determine Q is detected (step 140B), control system 30 may avoid surge of compressor 10 by operating bypass valve 32 when head rise to surge 64B decreases below a threshold head rise to surge value (step 150B). Likewise, in the event of failure of a sensor used to determine N (step 140C), control system 30 may operate bypass valve 32 when turndown 64C decreases below a threshold turndown value (step (150C). The control system 30 may continue using the compressor map unaffected by the sensor failure until the sensor failure is corrected.

It is also contemplated that control system 30 may use modifications of the technique illustrated in FIG. 3 to avoid surge of compressor 10. For example, in some embodiments, control system 30 may detect a sensor failure by the location of operating point on the compressor maps. That is, as described earlier, the location of an operating point outside an expected range may indicate a faulty sensor. In some embodiments, in the event of a sensor failure that affects two or more operating parameters, control system 30 may determine some of the affected operating parameters using thermodynamic relations and other sensor data. In some embodiments, when all sensors are functioning correctly, control system 30 may update (continuously or periodically) the location of operating points 60A and 60B on first compressor map 50A and second compressor map 50B respectively, based on the location of operating point 60C, to correct for changes in gas composition.

Using three compressor maps, each of which is defined by a different pair of three operating parameters of compressor 10, allows the continued operation of compressor 10 when a sensor fault causes an error in one of the operating parameters. In some cases, the faulty sensor may be rectified while the compressor is functioning, while in other cases, the faulty sensor may be rectified after the compressor is shut down safely at an opportune time. In either case, unanticipated shut down of the compressor may be avoided. Preventing unanticipated shut down of the compressor may increase the efficiency of a business organization using the compressor.

It will be apparent to those skilled in the art that various modifications and variations can be made to the disclosed method of compressor operation. Other embodiments will be apparent to those skilled in the art from consideration of the specification and practice of the disclosed method of compressor operation. It is intended that the specification and examples be considered as exemplary only, with a true scope being indicated by the following claims and their equivalents.

What is claimed is:

1. A method of operating a compressor of a compressor system using three models, each model of the three models describing a surge line of the compressor as a function of any two of three operating parameters of the compressor, the three operating parameters including a head (H), a flow (Q), and a speed (N), comprising:

measuring operating characteristics of the compressor system using sensors;

determining a current value of the three operating parameters based on at least some of the measured operating characteristics;

locating operating points of the compressor on each of the three models based on the current value of the operating parameters;

monitoring a variation of the located operating points over time on each of the three models to identify a sensor fault that affects the determination of one of the operating parameters; and avoiding a surge of the compressor using one model of the three models, the one model being the one model of the three models that is a function of two operating parameters unaffected by the sensor fault, to initiate a surge avoidance action when the one model of the three models indicates an impending surge.

2. The method of claim 1, wherein the three models include a first model that describes the surge line as a function of the speed (N) and the flow (Q), a second model that describes the surge line as a function of the head (H) and the speed (N), and a third model that describes the surge line as a function of the head (H) and the flow (Q).

3. The method of claim 2, wherein avoiding the surge of the compressor includes:

selecting the first model when the sensor fault affects the determination of the head (H), selecting the second model when the sensor fault affects the determination of the flow (Q), and selecting the third model when the sensor fault affects the determination of the speed (N).

4. The method of claim 3, wherein selecting the first model includes determining a surge margin, the surge margin being a difference in the flow (Q) at the operating point and the flow (Q) at the surge line at a constant the speed (N), and avoiding the surge of the compressor includes initiating the surge avoidance action when the surge margin decreases below a threshold value.

5. The method of claim 3, wherein selecting the second model includes determining a head rise to surge, the head rise to surge being a difference in the head (H) at the operating point and the head (H) at the surge line at a constant the speed (N), and avoiding the surge of the compressor includes initiating the surge avoidance action when the head rise to surge decreases below a threshold value.

6. The method of claim 3, wherein selecting the second model includes determining a turndown, the turndown being a difference in the head (H) at the operating point and the head (H) at the surge line at a constant the flow (Q), and avoiding the surge of the compressor includes initiating the surge avoidance action when the turndown decreases below a threshold value.

7. The method of claim 2, wherein locating the operating points of the compressor includes locating a first operating point on the first model, a second operating point on the second model, and a third operating point on the third model, the first operating point being based on the current value of the speed (N) and the flow (Q), the second operating point being based on the current value of the head (H) and the speed (N), and the third operating point being based on the current value of the head (H) and the flow (Q).

8. The method of claim 7, wherein locating the operating points of the compressor includes adjusting a location of the first operating point and a location of the second operating point based on a location of the third operating point.

9. The method of claim 7, wherein identifying the sensor fault includes identifying the sensor fault based on a location of one or more of the first operating point, the second operating point, and the third operating point.

10. The method of claim 1, wherein avoiding surge includes initiating the surge avoidance action when a distance between the operating points and the surge line on the one model is below a threshold distance.

11. The method of claim 10, wherein the surge avoidance action includes bypassing a compressed gas from a discharge side of the compressor to an intake side.

12. A method of operating a compressor comprising:

determining values of three operating parameters of the compressor based on measured characteristics of the compressor, the three operating parameters being a head (H), a flow (Q), and a speed (N);

describing a surge line of the compressor using three models, the three models including a first model that describes the surge line as a function of the speed (N) and the flow (Q), a second model that describes the surge line as a function of the head (H) and the speed (N), and a third model that describes the surge line as a function of the head (H) and the flow (Q);

selecting one model of the three models when a fault affects the determining of the value of one of the three determined operating parameters; and performing a bypass when the one model of the three models indicates an impending surge condition.

13. The method of claim 12, further including locating a first operating point on the first model, a second operating point on the second model, and a third operating point on the third model, the first operating point being defined by the determined values of the speed (N) and the flow (Q), the second operating point being defined by the determined values of the head (H) and the speed (N), and the third operating point being defined by the determined values of the head (H) and the flow (Q).

14. The method of claim 13, further including detecting the fault, the fault being a defect of a sensor used to measure at least one of the measured characteristics of the compressor.

15. The method of claim 14, wherein detecting the fault includes detecting the fault based on a location of one or more of the first operating point, the second operating point, and the third operating point.

16. The method of claim 14, wherein performing the bypass includes;

performing the bypass when a distance of the first operating point to the surge line decreases below a first threshold distance, if the one model is the first model, performing the bypass when a distance of the second operating point to the surge line decreases below a first threshold distance, if the one model is the second model, and performing the bypass when a distance of the third operating point to the surge line decreases below a first threshold distance, if the one model is the third model.

17. A method of operating a compressor, comprising:

determining a plurality of operating parameters of the compressor based on measurements of one or more sensors;

monitoring a surge condition of the compressor using multiple surge models, wherein each one of the multiple surge models is based on only two of the determined plurality of operating parameters;

monitoring the compressor to detect an error in the determining of one of the plurality of operating parameters;

updating at least one of the multiple surge models using another of the multiple surge models if the error is not detected; and operating the compressor using a surge model of the multiple surge models unaffected by the error if the error is detected.

18. The method of claim 17, further including establishing the multiple surge models based on the determined plurality of operating parameters, wherein the determined plurality of operating parameters include a head (H), a flow (Q), and a speed (N), and the established multiple surge models include a first model that describes the surge condition as a function of the speed (N) and Q, a second model that describes the surge condition as a function of the head (H) and the speed (N), and a third model that describes the surge condition as a function of the head (H) and Q.

19. The method of claim 18, wherein operating the compressor includes operating the compressor using the first model when the detected error affects the head (H), operating the compressor using the second model when the detected error affects the flow (Q), and operating the compressor using the third model when the detected error affects the speed (N).

20. The method of claim 19, wherein operating the compressor using the first model includes initiating a surge avoidance action based on a threshold value of the flow (Q).

* * * * *